United States Patent [19]

Masuda et al.

[11] 4,174,606

[45] Nov. 20, 1979

[54] ELECTRONIC WATCH HAVING STOPWATCH FUNCTION

[75] Inventors: Toshiyuki Masuda, Nara; Takehiko Sasaki, Yamatokoriyama, both of Japan

[73] Assignee: Sharp Kabushiki Kaisha, Osaka, Japan

[21] Appl. No.: 798,390

[22] Filed: May 19, 1977

[30] Foreign Application Priority Data

May 20, 1976 [JP] Japan ..... 51-58929

[51] Int. Cl.[2] ..... G04F 8/00; G04B 19/30; G04F 7/04

[52] U.S. Cl. ..... 58/39.5; 58/50 R; 58/94

[58] Field of Search ..... 58/23 R, 39.5, 38 R, 58/50 R, 74, 145 D, 152 R, 153; 235/92 T; 340/309.4, 309.5

[56] References Cited

U.S. PATENT DOCUMENTS

| | | | |
|---|---|---|---|
| 3,789,600 | 2/1974 | Champan | 58/39.5 |
| 3,790,584 | 2/1974 | Dargent | 58/50 R |
| 3,795,099 | 3/1974 | Tsuruishi | 58/23 R |
| 3,854,277 | 12/1974 | Samejima et al. | 58/39.5 |
| 3,943,696 | 3/1976 | Portmann et al. | 58/23 R |
| 4,058,971 | 11/1977 | Epperson | 58/39.5 |

*Primary Examiner*—Vit W. Miska

*Attorney, Agent, or Firm*—Birch, Stewart, Kolasch and Birch

[57] ABSTRACT

A digital display type electronic watch having a stopwatch function and comprising a display adapted for selective indication by the common display of horological information in a normal operation mode and chronometrical information in a stopwatch mode, characterized in that a corner for counting the clock pulses for measuring time in the stopwatch mode is divided into two groups for the more and less significant digit portions of the chronometrical information, a gate is provided for selectively and sequentially applying the said more and less significant digit portions of the chronometrical information to the display in the stopwatch mode, and a control signal generator is provided such that a first and second operations of a switch defines initiation and termination of the counting operation by said counter, a further operation of the switch triggers a timer providing an output for a predetermined time period which output is applied to said gate, whereby the gate is switched such that the displayed portion of said more and less significant portions of said chronometrical information is changed, and a further operation of the switch only when the output is obtained from the timer generates a clear signal of the said counter, whereby chronometrical information of a larger value can be displayed to the order of hour without increasing the number of digit positions in the display, while repetitive operations of a single switch enable various operation states in the stopwatch mode.

17 Claims, 6 Drawing Figures

ELECTRONIC WATCH HAVING STOPWATCH FUNCTION

BACKGROUND OF THE INVENTION

1. Field of the Invention

The present invention relates to a digital display type electronic watch. More specifically, the present invention relates to an improvement in a digital display type electronic watch having a stopwatch function.

2. Description of the Prior Art

A typical conventional digital display type electronic watch comprises six or four digit positions each adapted for displaying a selected numeral, such that the current time information is displayed. Such six digit positions are usually used such that the most significant two digit positions are allotted to indicate hour information, the middle significant two digit positions are allotted to indicate minute information and the least significan two digit positions are allotted to indicate second information. According to another example, such six digit positions are used such that the least significant two digit positions are allotted to indicate date information instead of second information. Similarly, such four digit positions are typically used such that the more significant two digit positions are allotted to indicate hour information and the less significant two digit positions are allotted to indicate minute information.

A digital display type electronic watch having a stopwatch function has also been proposed and put in practical use. In case where such a stopwatch function is incorporated in a digital display type electronic watch having six digit positions, merely chronometrical information concerning the measured time can be displayed as accurately as the order of minute, second and one tenth second at the best, inasmuch as the least significant two digit positions should be allotted to display the one tenth second information and hence the remaining more significant digit positions must be allotted to indicate only minute and second information. If the chrohometrical information should be indicated as more accurately as the order of one hundredth second, for example, the largest possible measured time information would be limited to a smaller value. Nevertheless, in such a situation where such an electronic watch having a stopwatch function is used to measure record time in a marathon game, for example, a time period as long as more than say two hours must be indicated as accurately as the order of one tenth second information at the least. However, a conventional digital display type electronic watch having a stopwatch function can merely indicate chronometrical information concerning the measured time up to the order of less than one hundred minutes or sixty minutes, depending on how large numerical value can be indicated in the most significant two digit positions in such an electronic watch. Thus, it is desired that chronometrical information can be displayed in such an electronic watch having a stopwatch function up to the hour order and to the accuracy of one tenth second order without any substantial additional arrangement.

SUMMARY OF THE INVENTION

Briefly stated, the present invention comprises an electronic watch having a stopwatch function, comprising; means for generating a time reference signal, means responsive to said time reference signal for generating a chronometrical information signal representative of the measured time information, said chronometrical information having a more significant digit information portion and a less significant digit information portion, means for displaying said chronometrical information, manually operable means for defining initiation and termination of a time period being measured in terms of said chronometrical information, means responsive to said manually operable defining means for making said chronometrical information signal generating means responsive to said time reference signal generating means, and means for selectively making said display means sequentially responsive to one and the other of said more significant digit information portion and said less significant digit information portion of said chronometrical information in said chronometrical information mode. As a result, the chronometrical information of a larger value as large as the hour order can be displayed as accurately as the one tenth order at the least without increasing the number of digit positions in the display means.

The present invention also comprises an electronic watch having a stopwatch function and comprising a display adapted for selective indication by the common display of horological information and chronometrical information, said watch comprising; means for generating a time reference signal, means responsive to said time reference signal for generating a horological information signal representative of the current time information, means responsive to said time reference signal for generating a chronometrical information signal representative of the measured time information, said chronometrical information having a more significant digit information portion and a less significant digit information portion, means for selecting a horological information mode and a chronometrical information mode, means for displaying said horological information and chronometrical information, means responsive to said mode selecting means for selectively providing said horological information signal or said chronometrical information signal to said display means, manually operable means for defining initiation and termination of a time period being measured in terms of said chronometrical information, means responsive to said manually operable defining means for making said chronometrical information signal generating means responsive to said time reference signal generating means, and means for selectively making said display means sequentially responsive to one and the other of said more significant digit information portion and said less significant digit information portion of said chronometrical information in said chronometrical information mode. As a result, the chronometrical information of a larger value as large as the hour order can be displayed as accurately as the one tenth order at the least without increasing the number of digit positions in the display means.

Preferably, said manually operable defining means comprises a single input means, and state store means responsive to a first input of said single input means for assuming a first store state and responsive to a second input of said single input means for assuming a second store state, wehreby said initiation and termination of said time period being measured are defined responsive to said first store state of said state store means. As a result, initiation and termination of a time period being measured in terms of said chronometrical information can be achieved by using a single input means.

More preferably, said means for making said display means selectively and sequentially responsive to the more significant digit information portion or the less significant digit information poriton comprises means responsive to said second store state of said state store means and a further input of said single input means for providing a switching signal, and means responsive to said switching signal for switching said display means to be selectively and sequentially responsive to said more significant digit information poriton or said less significant digit information portion. Thus, selective switching of said display for selective and sequential indication by said common display means of said more significant digit information poriton or said less significant digit information portion as well as said initiation and termination of a time period being measured can be achieved by using a single input means.

More preferably, said switching signal providing means may comprise timing means for determining a predetermined time period for providing said switch signal during that time period, whereby said display means ragains the original display state after that time period. More preferably, means is provided responsive to said switching signal and a further input of said single input means for providing a clear signal for clearing said chronometrical information signal generating means, whereby said single input means further enables clearing of said chronometrical information signal generating means.

Therefore, a principal object of the present invention is to provide an electronic watch having a stopwatch function, wherein chronometrical information of a larger value as large as the hour order can be displayed with the accuracy of the order of one tenth second at the least without increasing the number of digit positions in the display.

Another principal object of the present invention is to provide an electronic watch having a stopwatch function and comprising a display adapted for selective indication by the common display of horological information and chronometrical information, wherein chronometrical information of a larger value as large as the hour order can be displayed with the accuracy of the order of one tenth second at the least without increasing the number of digit positions in the display.

A further object of the present invention is to provide an electronic watch having a stopwatch function, which may comprise a display adapted for selective indication by the common display of horological information and chronometrical information, wherein said chronometrical information comprises a more significant digit information portion and a less significant digit information portion and said display is adapted such that said more significant digit information portion and said less significant digit information portion are sequentially displayed responsive to manual switch instruction.

A further object of the present invention is to provide an electronic watch having a stopwatch function, which may comprise a display adapted for selective indication by the common display of horological information and chronometrical information, wherein said chronometrical information comprises a more significant digit information portion and a less significant digit information portion, said display is adapted such that said more significant digit information portion and said less significant digit information poriton are sequentially displayed responsive to manual switch instruction, and said manual switch instruction for switching of said display as well as manual instruction for initiation and termination of a time period being measured in terms of said chronometrical information can be achieved by the use of a single manual input means.

Still a further object of the present invention is to provide an electronic watch having a stopwatch function, which may comprise a display for selective indication by the common display of horological information and chronimetrical information, wherein said chronometrical information comprises a more significant digit information poriton and a less significant digit information portion, said display is adapted such that said more significant digit information portion and said less significant digit information poriton are sequentially displayed responsive to an output from timing means to be triggered by manual switch instruction and to return to the original state after the lapse of a predetermined time period, whereby switching of display between the more significant digit information portion and the less significant digit information of said chronometrical information can be regained after the lapse of said predetermined time periaod.

Still another object of the present invention is to provide an electronic watch having a stopwatch function, which may comprise a display adapted for selective indication by the common display of horological information and chronometrical information, wherein said chronometrical information comprises a more significant digit information portion and a less significant digit information portion, said display is adapted such that said more significant digit information portion and said less significant digit information poriton are sequentially displayed responsive to an output from timing means to be triggered by manual switch instruction and to return to the original state after the lapse of a predetermined time period, and said chronometrical information is cleared responsive to a further manual switch instruction as entered if and when the output is obtained from said timing means. Preferably said manual switch instruction for swtiching of said display means and said further manual instruction for clearing said chronometrical information as well as manual instruction for initiation and termination of a time period being measured in terms of said chronometrical information are achieved by a single input means.

According to a feature of the embodiment shown, an electronic watch having a stopwatch function and comprising a display adapted for selective display of horological information and chronometrical information is provided, wherein in the chronometrical information mode only the information protion for the hour, minute and second of the measured time period are first displayed by the use of six digit positions in the display, whereupon the display is switched responsive to manual switch instruction and the one tenth second portion of the chronometrical information of the measured time period is displayed by the use of any one of the display portions for the hour, minute and second, whereby chronometrical information of a larger value as large as the order of so many hours can be displayed. According to another feature of the embodiment shown, a timer is provided to allow display of said one tenth second portion of said chronometrical information for a predetermined time period, say 0.5 second to two hours, whereupon the display is adapted to resume the original display of the hour, minute and second portion of said chronometrical information, whereby the same chronometrical information can be observed repeatedly as desired which is as large as the hour order and as accurately as the one tenth second order. According to a further feature of the embodiment shown, the electronic watch is structured such that manual instruction during the time period when the said one tenth second portion of said chronometrical information is displayed enables resetting of said chronometrical information, whereby resetting of said chronometrical information as well as switching the display and manual instruction for measurement of a time period in the chronometrical information mode can be achieved by the same switch, with the result that switch arrangement can be simplified.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
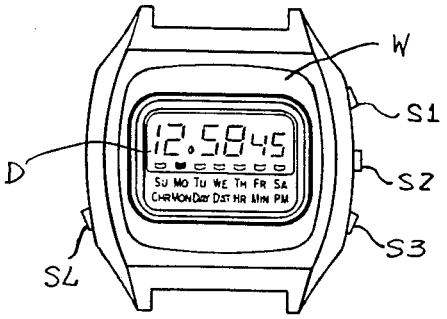
FIG. 1 shows a plan view of a digital display type electronic wrist watch having a stopwatch funtion in which the present invention can be advantageously employed.

FIG. 1 shows a plan view of a digital display type electronic wrist watch having a stopwatch function and comprising a display adapted for selective indication by the common display of horological information and chronometrical information. Thus, an electronic watch W is shown comprising a single common digital display D. The watch W is also shown comprising switches S1, S2, S3 and SL. Various types of electronic watches manually operable by such switches to perform various different functions have been proposed and put in practical use. The embodiment shown, however, is adapted such that manual operation of these switches S1, S2, S3 and SL achieves the following various functions. More specifically, in the embodiment shown, the switch S1 is aimed to select various operation modes, such as a normal horological information mode for displaying the current time information, a stopwatch or chronometrical information mode for displaying the measured time information, a correction mode for correcting or calibrating the current time information, or the like. The switch S2 is aimed at selection of various different manners of display in the said normal horological information mode, instructions for start or initiation and stop or termination of time measurement in the stopwatch or chronometrical information mode, switching of the display to a less significant digit portion of the chronometrical information in the stopwatch or chronometrical information mode, zero resetting of the chronometrical information, and returning from the correction mode to the normal mode. Switch S3 is aimed at zero calibration, start instruction after "minute" correction and resetting, quick advancing correction in the correction mode, and setting in cooperation with the switch S1. The switch SL is aimed at energization of a light source for illuminating the display in case where the display is implemented by liquid crystal display devices. Since almost all these various controls by the use of these switches, only except for the controls only related to the present invention, are well known to those skilled in the art, it is not believed necessary to describe in more detail these known various controls by the switches. On the other hand, the controls only related to the present invention will be more specifically described in the following with reference to a circuit configuration adapted for such controls.

Figure 1A:
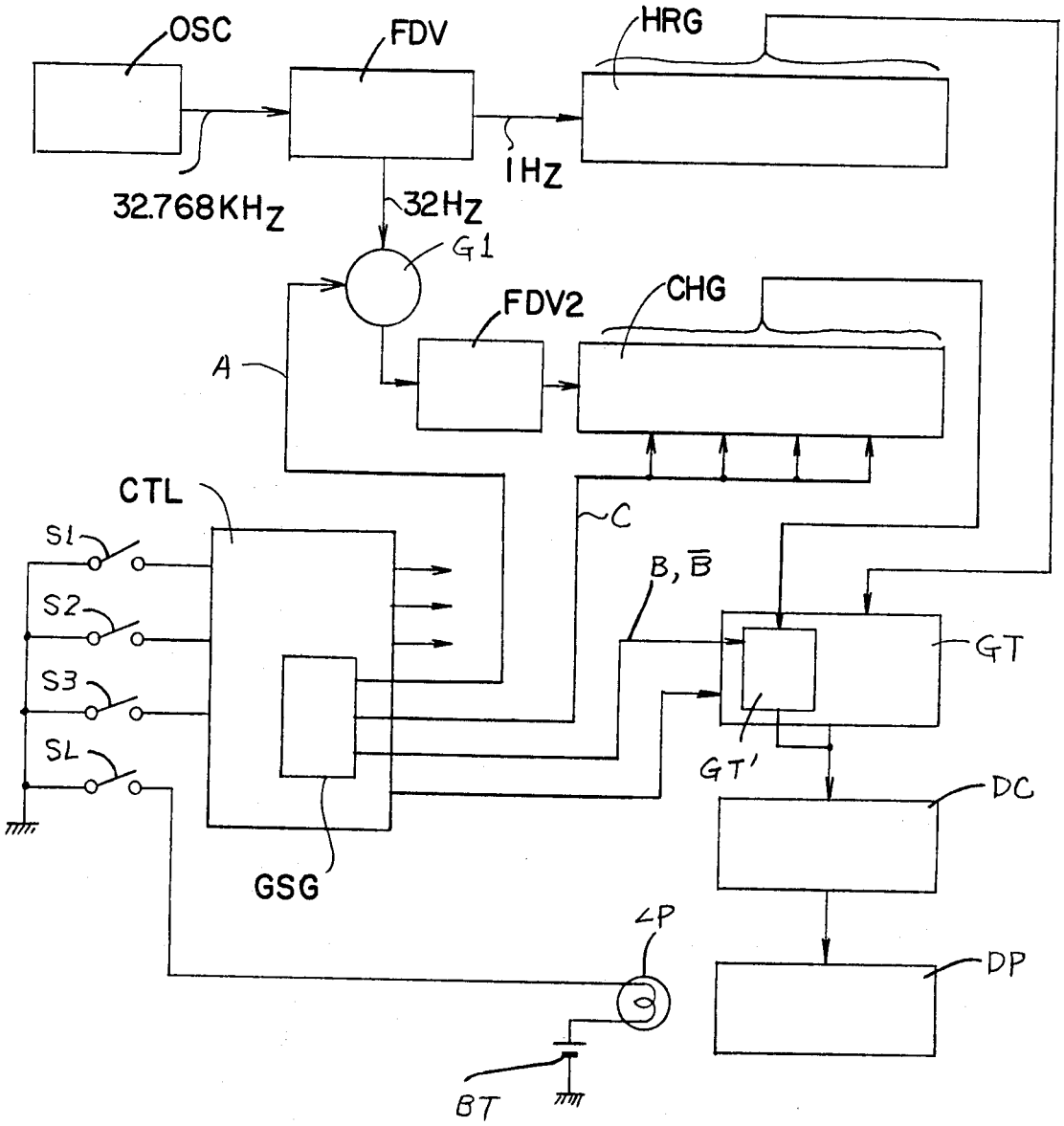
FIG. 1A shows a block diagram of a digital display type electronic watch having a stopwatch function in accordance with the present invention.

FIG. 1A shows a block diagram of a digital display type electronic watch having a stopwatch function which employs the present invention. The embodiment shown comprises an oscillator OSC operatively coupled to a crystal resonator (not shown) for generating a time base signal in the form of clock pulses of the frequency of say 32.768 KHz, a frequency divider FDV for frequency dividing the said frequency to 1 Hz and 32 Hz, a horological information signal generator HRG responsive to the output of the frequency divider FDV of the frequency of 1 Hz for generating a horological information signal representative of the current time information, such as the date of the month, the date of the week, the hour, minute and second, a chronometrical information signal generator CHG responsive to the output of the frequency divider FDV of the frequency of 32 Hz for generating a chronometrical information signal representative of measured time information, a gate GT for selectively withdrawing either of the outputs from the horological information signal generator HRG and the chronometrical information signal generator CHG, a decoder DC for decoding the horological information signal and the chronometrical information signal into a display driving signal, and a display DP responsive to the display driving signal to provide a visual indication of the selected horological information or the chronometrical information. In the embodiment shown, the horological information signal generator HRG is adapted to generate the horological information signal representative of the current time information including the date of the month, the date of the week, the hour, minute, and second, and the chronometrical information signal generator CHG is adapted to generate a chronometrical information signal representative of the measured time information which is large enough to comprise the hour order but is accurate enough to comprise the one tenth second order. To that end, the output of the frequency divider FDV of the frequency of 32 Hz is applied through a gate G1 to another frequency divider FDV2, wherein the frequency of 32 Hz is frequency divided by 1/3.2 to provide the frequency of ten Hz, which is applied to the chronometrical information signal generator CHG. The generators HRG and CHG ususlly comprise a counter, as well known to those skilled in the art.

It is pointed out that the chonometrical information signal generator CHG comprises a more significant digit information portion including the hour, minute, and second information, and a less significant digit information portion including the one tenth second information. The present invention is directed to an improved scheme for selectively and sequentially displaying the more significant digit information portion and the less significant digit information portion in the common display DP responsive to manual switch instruction. To that end the gate circuit GT comprises a sequential gating circuit GT' which is adapted to be responsive to gating signals B and $\overline{B}$. In other words, the present invention is directed to an improvement in display of the chronometrical information in the stopwatch or chronometrical information mode. Thus, the FIG. 1A embodiment has been shown with some emphasis on the circuit portion relating to chronometrical information. More specifically, the gate G1 is shown enabled by a gating signal A for the purpose of making the chronometrical information signal generator CHG responsive to the time base signal from the frequency divider FDV only during the time period when the said gating signal A is obtained, whereby initiation and termination of a time period being measured is defined. The chronometrical information signal generator CHG is also shown adapted to be cleared or to be zero reset by a clear signal C which is obtained when a given time period was measured and another time period is to be measured.

The FIG. 1A embodiment is shown comprising a control CTL operatively coupled to the switches S1, S2, and S3 to generate various control signals and gating signals. One of the control signals is shown being applied to the gate circuit GT to switch visual indication by the display DP between the horological information and the chronometrical information. Such switching between the horological information signal and the chronometrical information signal to be applied to the display DP is also well known to those skilled in the art. Although the control CTL is also adapted to generate various control signals, it is not believed necessary to describe in more detail such control signals, inasmuch as these control signals are also well known to those skilled in the art and are not directly related with the present invention. As described previously, in the FIG. 1A embodiment, the signals A, B, $\overline{B}$, and C are of major concern. Such signals are shown generated by a gate signal generator GSG. In FIG. 1A, the switch SL is shown connected in series with a battery BT and a light source LP, which is provided to illuminate the display DP upon depression of the switch SL.

Figure 2:
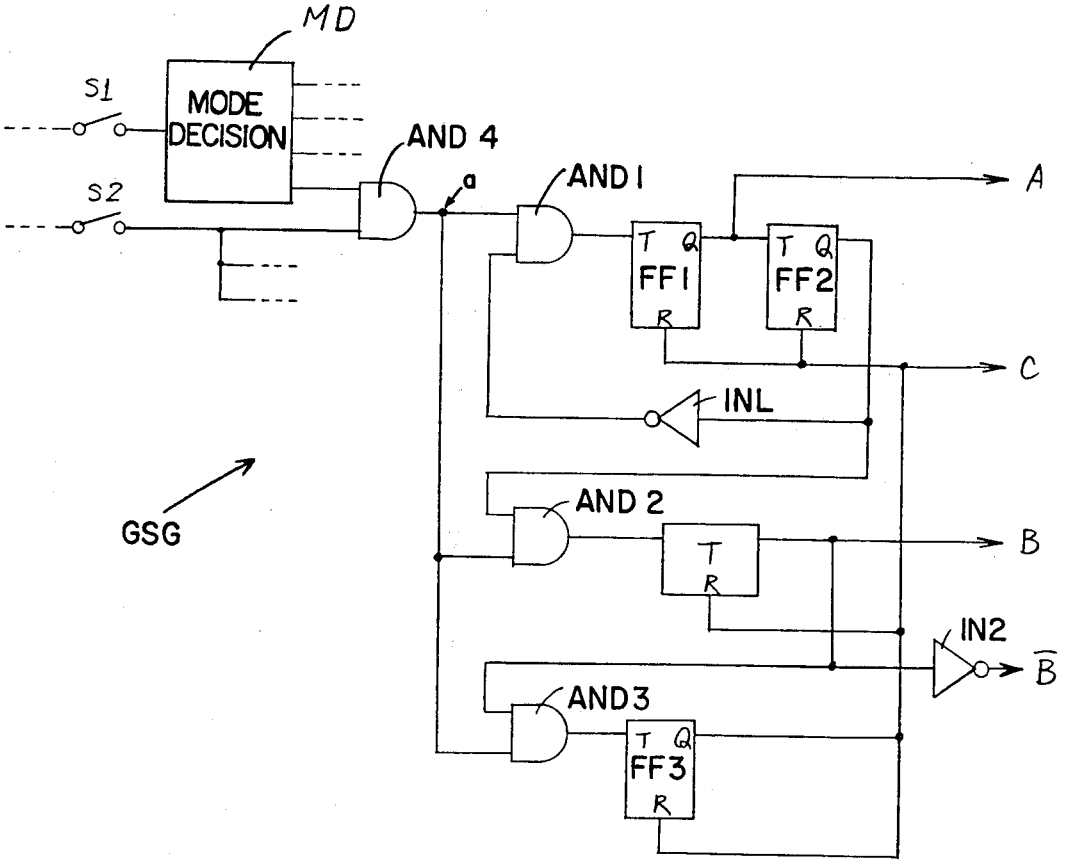
FIG. 2 shows a block diagram of a portion of a control for generating various control signals.
Figure 3:
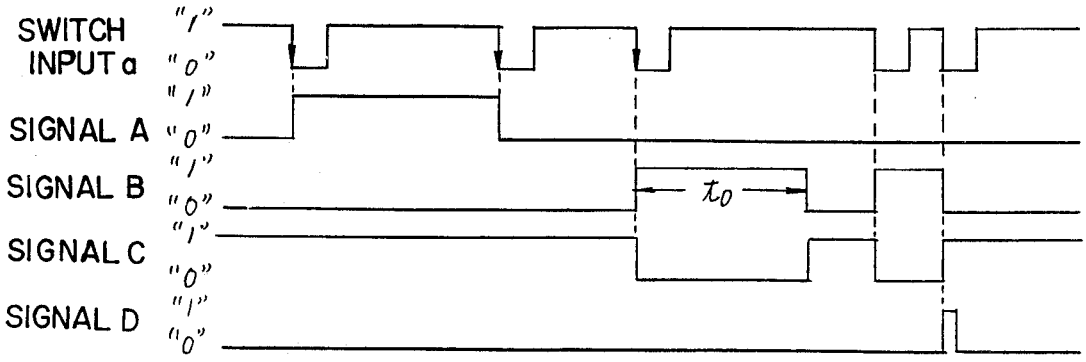
FIG. 3 shows waveforms of the control signals shown in FIG. 2.

FIG. 2 shows a block diagram of the gate signal generator GSG and FIG. 3 shows waveforms of various signals generated by the gate signal generator GSG. Referring to FIG. 2, an AND gate AND4 is connected to receive an output representative of a stopwatch mode from a mode decision circuit MD adapted to determine various modes responsive to manual operation of the switch S1 and also to receive an output of the switch S2. The output from the AND gate AND4 is connected to one input of AND gates AND1, AND2, and AND3. The output of the AND gate AND1 is connected to the input terminal of a T type flip-flop FF1. The Q output of the flip-flop FF1 is withdrawn as the gate signal A and is also applied to the input of a T type flip-flop FF2. The Q output of the flip-flop FF2 is applied through an invertor IN1 to another input of the AND gate AND1 and is also directly applied to another input of the AND gate AND2. The output of the AND gate 2 is applied to a timer T which is triggered by the output of the AND gate AND2 and returns to the original state after the lapse of the predetermined time period t0. The otuput of the timer T is withdrawn as the gating signal B and is withdrawn through an invertor IN2 as the gating signal $\overline{B}$. The output of the timer T is also applied to another input of the AND gate AND3. The output of the AND gate AND3 is applied to the input of a T type flip-flop FF3. The 9 output of the flip-flop FF3 is withdrawn as the clear signal C and is also applied to the flip-flops FF1, FF2, and FF3 and to the timer T as a reset signal.

In operation, let it be assumed that by way of an initial condition the T type flip-flops FF1, FF2, and FF3 and the timer T have been reset. For the purpose of achieving the stopwatch or chronometrical information mode, the switch S1 is operated. As a result the mode decision circuit MD provides a stopwatch mode signal to the input of the AND gate AND4. Thus, the AND gate AND4 is kept enabled during the stopwatch mode. Therefore, repetitive depression of the switch S2 generates a train of pulses which is allowed to pass through the AND gate AND4 to appear at the junction a. Such successive pulses appearing at the junction a are identified as a1, a2, a3, . . . , an and an +1. Since the output of the switch S2 is normally the high level and depression of the switch S2 provides the low level output, such a train of pulses is shown in FIG. 3 as a train of negative going pulses.

Since the flip-flop FF2 has been reset and the low level output of the flip-flop FF2 is inverted by the invertor IN1, the high level output of the invertor IN1 has been applied to the AND gate AND1. If and when the first pulse a1 is obtained as a result of a first operation of the switch S2, the logical level at the junction a changes from the logic one to the logic zero at the leading edge of the first pulse a1 and the flip-flop FF1 is triggered by the leading edge of the first pulse a1 of the fall portion, whereby the storing state of the flip-flop FF1 is reversed or set. Such a state of the flip-flop FF1 is kept until the switch S2 is operated again and the second pulse a2 is obtained. If and when the second pulse a2 is obtained through a second operation of the switch S2, similarly the flip-flop FF1 is again triggered by the second pulse a2 applied through the AND gate AND1 at the leading edge thereof, whereby the flip-flop FF1 resumes the original state or is reset. Since at that time the output Q of the flip-flop FF1 turns from the logic one to the logic zero, the flip-flop FF2 is triggered by the fall edge of the Q output of the flip-flop FF1. Since the flip-flop FF2 is reversed of the storing state, the Q output of the flip-flop FF2 turns to be the logic one, whereby the AND gate AND1 is opened or disabled and any further input to the flip-flop FF1 is interrupted. The Q output of the flip-flop FF1 is withdrawn as the gating signal A, which remains the logic one from the first operation to the second operation of the switch S2.

Since the flip-flop FF2 has been set and the high level output of the flip-flop FF2 has been applied to the AND gate AND2, the third pulse a3 obtained through a third operation of the switch S2 is allowed to pass therethrough to trigger the timer T. The timer T may be implemented by a monostable multivibrator, a counter or the like. The timer T is triggered by the leading fall edge of the third pulse a3 and returns to the original state after the lapse of the predetermined time period t0. If the timer T is implemented by a counter, the counter is adapted to be supplied with a train of clock pulses so that a predetermined number of pulses are counted to provide a count up signal. The output of the timer T is withdrawn as the gating signal B and the inverted output through the invertor IN2 is withdrawn as the gating signal $\overline{B}$. After once the timer T returns to the original state after the lapse of the said predetermined time period t0, a further pulse as a result of a further operation of the switch S2 serves as the said third pulse a3 and the same operation is repeated. More specifically, the timer T1 is again triggered and after the lapse of the same time period the timer T returns to the original state. As a result, a further set of gating signals B and $\overline{B}$ is provided.

Now consider a case where such a further pulse is obtained as a result of such a further operation of the switch S2 during the said time period when the timer T has been triggered and the output of the timer T is the logic one. Referring to FIG. 3, assuming that the timer T is triggered by the pulse an as a result of the n-th operation of the switch S2, whereby the output of the timer T has become the logic one, during the said time period t0 the AND gate AND3 is enabled by the output of the timer T. Assuming further that a further pulse an +1 is obtained as a result of the (n+1)th operation of the switch S2, such a further pulse an +1 is allowed to pass through the AND gate AND3, thereby to trigger the flip-flop FF3. As a result, the flip-flop FF3 is reversed of the storing state. The output of the logic one from the flip-flop FF3 is applied to the reset terminals R of the flip-flops FF1, FF2 and the timer T, thereby to reset the same The output of the flip-flop FF3 is also applied to its own reset terminal R, whereby the flip-flop FF3 is also reset. As a result, the Q output of the logic one is obtained from the flip-flop FF3 for a short while. Such an output from the flip-flop FF3 is withdrawn as the clear signal C.

Figure 4:
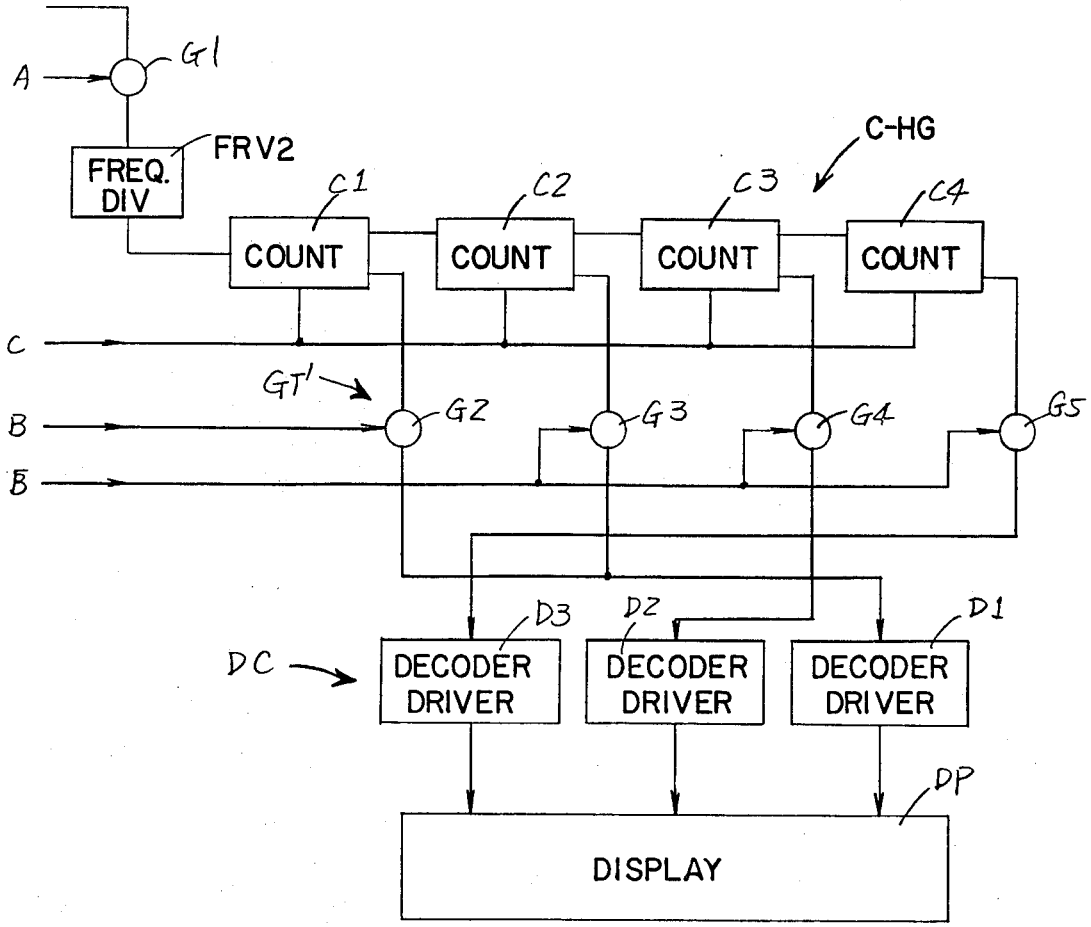
FIG. 4 shows a block diagram of another portion of a control in the FIG. 2 embodiment.

FIG. 4 is a block diagram showing in more detail the chronometrical information signal generator CHG, the gate circuit GT' and the decoder DC, together with the gate G1, the frequency divider FDV2, and the display DP. The chronometrical information signal generator CHG comprises cascade connected counters C1, C2, C3 and C4 each allotted for the one tenth second digit portion, the second digit portion, the minute digit portion, and the hour digit portion, respectively. The decoder DC comprises the most significant two-digit display decoder/driver D3, the middle significant two-digit display decoder/driver D2, and the least significant two-digit display decoder/driver D1. The hour counter C4, the minute counter C3, and the second counter C2 are connected through gates G5, G4, and G3, respectively, to the most significant two-digit display decoder/driver D3, the middle significant two-digit display decoder/driver D2 and the least significant two-digit display decoder/driver D1, respectively. The gates G5, G4, and G3 are connected to be enabled by the gating signal $\overline{B}$. The one tenth second counter C1 is also connected through a gate G2 to the least significant two-digit display decoder/driver D1 on an OR fashion. The gate G2 is connected to be enabled by the gating signal B. The gate G1 is connected to be enabled by the gating signal A. The counters C1, C2, C3 and C4 are connected to be reset by the clear signal C. The display DP may be implemented by an arrangement of light emitting diodes, an arrangement of segments of liquid crystal cells or the like and comprises six-digit display positions each adapted for displaying any of numerals.

Figure 5:
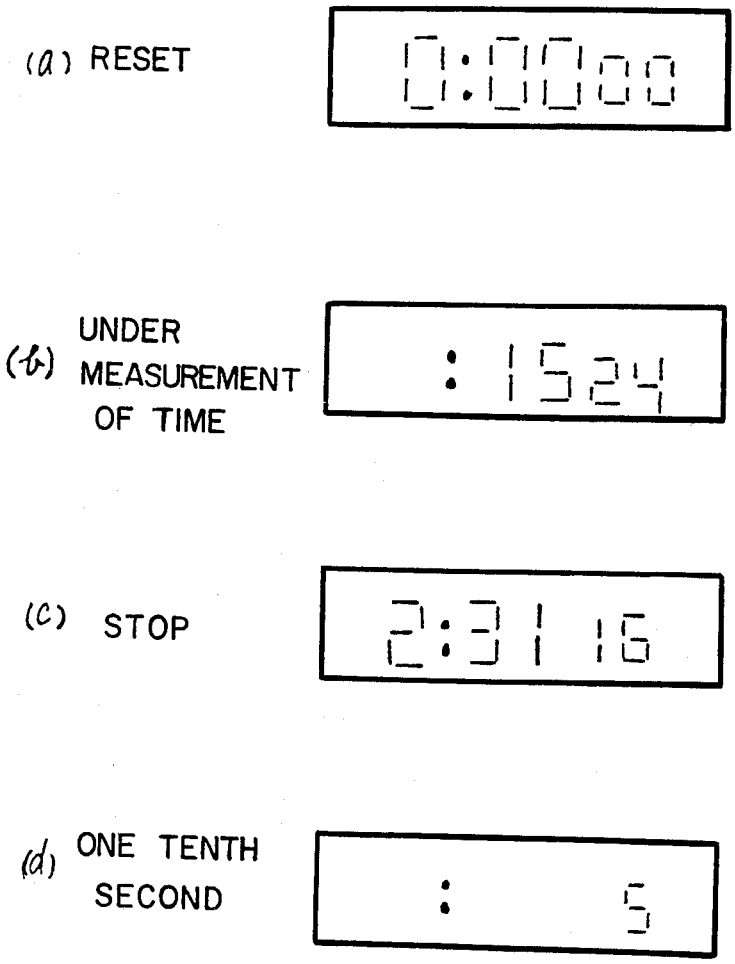
FIG. 5 shows several different manners of display in different operations of the electronic watch.

The operation of the FIG. 4 arrangement can be better understood with simultaneous reference to FIG. 5, which shows plan views of the display in several different operation states of the inventive electronic watch where the same has been placed in the stopwatch mode. Referring to FIG. 5(*a*) the display in the clear state is illustrated. A typical digital display type electronic watch is structured such that the most significant digit position merely comprises an arrangement for indicating only the numeral "1" if and when the hour of 10, 11 or 12 is to be indicated whereas the said numeral "1" is prevented from being indicated when the smaller hour value is to be indicated. Thus, in the FIG. 5(*a*) illustration, the most significant digit position has been suppressed from indicating the numeral "1" in such a reset state.

If and when the first pulse a1 is obtained as a result of a first operation of the switch S2, the gating signal A becomes the logic one and the gate G1 is enabled. As a result, the time base signal of the block pulses of 32 Hz is applied to the frequency divider FDV2 and the output signal of the clock pulses of 10 Hz is applied to the one tenth second counter C1. The counters C1 through C4 serve to count the time base signal while a carry to the more significant counters is effected during the counting operation. When the second pulse a2 is obtained as a result of a second operation of the switch S2, the signal A returns to the logic zero and the time base signal is prevented from entering to the chronometrical information signal generator CHG. Thus, the counters C1, C2, C3 and C4 only serve to count the clock pulses allowed to pass through the gate G1 during the time period initiated by the first pulse a1 and terminated by the second pulse a2.

The gating signal $\overline{B}$ has been the logic one since the above described reset state in the stopwatch mode. Therefore, the gates G3, and G4 and G5 are enabled and the count contents in the second counter C2, the minute counter C3, and the hour counter C4 are applied through the gates G3, G4, and G5, respectively, to the least two-digit display decoder/driver D1, the middle two digit display decoder/driver D2 and the most significant two-digit display decoder/driver D3, respectively. As a result, only the second, minute and hour digit portions of the chronometrical information as measured of the time period are displayed at the least two-digit, the middle two digit, and the most two-digit positions of the display DP. The FIG. 5(*b*) illustrates the manner of display when during the time measurement is progressing in the stopwatch mode, which shows that the time of fifteen minutes and twenty four seconds has passed since the time measurement is initiated.

FIG. 5(*c*) shows an example of display of the measured time when the time measurement is terminated. The display shows that the time at the time of termination of the time measurement is two hours, thirty one minutes and sixty seconds. The display at the stop state is continued until the switch S2 is again operated. Referring to FIG. 5(*b*) and (*c*), the digit positions exceeding the most significant digit of the indicated time numeral have been suppressed from being indicated of the numeral "zero". Such suppression of the numeral zero in the more significant digit positions than the indicated numeral value has been well known to those skilled in the art.

If the switch S2 is operated in such a stop state, the third pulse a3 is obtained and the timer T is triggered, whereby the gating signal $\overline{B}$ turns to the logic zero while the gating signal B turns to the logic one. As a result, the gates G3, G4 and G5 are closed or disabled and instead the gate G2 is opened or enabled. As a result, the count output of the one tenth counter C1 is applied through the gate G2 to the least significant two digit display decoder/driver D1. As a result, only the one tenth portion of the chronometrical information is indicated by the least significant two-digit positions in the display DP. The FIG. 5(*d*) shows an example of the display in such operation state. The display in this operation state means that the numeral has been indicated in terms of the one tenth second. Thus, it can be observed that the measured time is two hours thirty one minutes sixteen seconds and five.

After the lapse of the predetermined time period t0, the gating signal $\overline{B}$ turns to the logic one whereas the gating signal B turns to the logic zero, whereby the display DP returns to the display of the stop state as shown in FIG. 5(*c*). The said predetermined time period t0 of the timer T is selected to be sufficient enough to read the display of the time information for the one tenth second portion at the least but may be prolonged insofar as it is not too long for an operator to forget the previous indication of the more significant digit portion for the hour, minute, and second portions of the chronometrical information. Thus, the said predetermined time period t0 of the timer T may be preferably selected to be 0.5 second to two hours. As described previously, the display of the one tenth portion of the chronometrical information can be regained as desired by simply operating the switch 2 after the lapse of the said predetermined time period t0 of the timer T. In other words, according to the present invention, the chronometrical information can be repeatedly observed by operating the switch S2 such that the chronometrical information is divided into two portions and these two portions are sequentially indicated by the common display DP.

If and when the switch S2 is depressed during the said predetermined time period t0 of the timer T i.e. while the signal B is in the logic one after the previous pulse an is obtained, the pulse an +1 is obtained by a further operation of the switch S2, the clear signal C becomes the logic one. The clear signal C is applied to the flip-flops FF1, FF2, FF3 and the timer T, whereby these are reset, and the counters C1, C2, C3 and C4 are also reset. After the signal B returned to the logic one and the gating signal $\overline{B}$ returned to the logic zero, the reset state of the second counter C2, the minute counter C3, and the hour counter C4 are applied through the gates G3, G4, and G5 to the decoder/drivers D1, D2 and D3, whereby the reset state of the chronometrical information signal generator CHG is displayed, as shown in FIG. 5(*a*). Insofar as the stopwatch mode is maintained, the above described time measurement and switching of display for sequential indication of the more and less significant digit portions can be repeated.

Although in the foregoing the embodiment was described as adapted such that the chronometrical information comprises the hour, minute, second and one tenth second portions which are divided into two groups and sequentially displayed by using the six digit positions, any different number of digits may be used. The order of numerical value of the chronometrical information can also be changed as desired. For example, the least significant digit portion of the chronometrical information can be broadened to the one hundreth second order. By way of another modification, if the display is structured to be a four-digit type, the display may be adapted such that the more significant digit portion of the chronometrical information comprises the hour and minute portions while the least significant digit portion of the chronometrical information comprises the second and one tenth second portions.

Although this invention has been described and illustrated in detail, it is to be clearly understood that the same is by way of illustration and example only and is not to be taken by way of limitation, the spirit and scope of this invention, being limited only by the terms of the appended claims.

What is claimed is:

1. A digital display type electronic watch having a stopwatch function, comprising:

means for generating a time reference signal;

means responsive to said time reference signal for generating a chronometrical information signal representative of the measured time information, said measured time information comprising a more significant digit portion and a less significant digit portion;

means responsive to said chronometrical information signal generating means for displaying said measured time information;

means for instructing initiation and termination for defining a time period being measured in terms of said measured time information;

means responsive to said initiation/termination instructing means for coupling said chronometrical information signal generating means to said time reference signal generating means;

sequential response means operatively coupled to said chronometrical information signal generating means and said displaying means for making said displaying means sequentially responsive to one and the other of said more and less significant digit portions of said measured time information said sequential response means further comprising, means for commanding sequential response of said displaying means to said more significant or the less significant digit portion of said measured time information in said chronometrical information signal generating means; and means responsive to said sequential response commanding means for selectively and sequentially coupling said displaying means to said more significant or the less significant digit portion of said measured time information in said chronometrical information signal generating means, said sequential response commanding means further comprising, manually operable sequential response commanding means; and means responsive to said manually operable sequential response commanding means for making a timing operation for providing a timing signal for a predetermined time period, said sequential coupling means being adapted to be responsive to said timing signal of said timing means, whereby said display is switched from one to the other of said more and less significant digit portions of said measured time information in said chronometrical information signal generating means only during said predetermined time period of said timing means.

2. A digital display type electronic watch having a stopwatch function in accordance with claim 1, which further comprises means responsive to said time reference signal for generating a horological information signal representative of the current time information, means for selecting an operation mode of said electronic watch, said operation mode comprising a horological information mode and a chronometrical information mode, said displaying means being responsive to said horological information signal generating means or said chronometrical information signal generating means for displaying said current time information or said measured time information, and means responsive to said mode selecting means for selectively coupling said displaying means to said horological information signal generating means in said horological information mode and selectively coupling said displaying means to said chronometrical information signal generating means in said chronometrical information mode, said initiation/termination instructing means defining a time period being measured in terms of said measured time information in said chronometrical information mode.

3. A digital display type electronic watch having a stopwatch function in accordance with claim 1 which further comprises means for clearing said chronometrical information signal generating means.

4. A digital display type electronic watch having a stopwatch function in accordance with claim 3, said clearing means comprises manually operable means for commanding a clearing operation of said chronometrical information signal generating means, and means responsive to said manually operable clearing commanding means and said timing means for clearing said chronometrical information signal generating means.

5. A digital display type electronic watch having a stopwatch function in accordance with claim 2, wherein said initiation/termination instructing means comprises manually operable input means, means responsive to a first input of said manually operable input means for assuming a first store state and responsive to a second input of said manually operable input means for assuming a second store state.

6. A digital display type electronic watch having a stopwatch function in accordance with claim 5, which further comprises means operatively coupled to said state storing means for making said state storing means irresponsive to a third or further input of said manually operable input means.

7. A digital display type electronic watch having a stopwatch function in accordance with claim 6, wherein said sequential response means comprises means for commanding sequential response of said displaying means to said more significant or the less significant digit portion of said measured time information in said chronometrical information signal generating means, and means responsive to said sequential response commanding means for selectively and sequentially coupling said displaying means to said more significant or the less significant digit portion of said measured time information in said chronometrical information signal generating means.

8. A digital display type electronic watch having a stopwatch function in accordance with claim 7, wherein said sequential response commanding means comprises means responsive to said third or further input of said manually operable input means for providing a sequential response commanding signal, and said sequential coupling means is adapted to be responsive to said sequential response commanding signal.

9. A digital display type electronic watch having a stopwatch function in accordance with claim 7, wherein said sequential response commanding means further comprises means responsive to said sequential response commanding means for making a timing operation for providing a timing signal for a predetermined time period, said sequential coupling means being adapted to be responsive to said timing signal of said timing means, whereby said display is switched from one to the other of said more and less significant digit portions of said measured time information in said chronometrical information signal generating means only during said predetermined time period of said timing means.

10. A digital display type electronic watch having a stopwatch function in accordance with claim 9, which further comprises means for clearing said chronometrical information signal generating means.

11. A digital display type electronic watch having a stopwatch function in accordance with claim 9, which further comprises means responsive to said timing means and said further input of said manually operable input means for clearing said chronometrical information signal generating means.

12. A digital display type electronic watch having a stopwatch function, comprising:

means for generating a time reference signal;

means responsive to said time reference signal for generating a chronometrical information signal representative of the measured time information, said measured time information comprising a more significant digit portion and a less significant digit portion;

means responsive to said chronometrical information signal generating means for displaying said measured time information;

means for instructing initiation and termination for defining a time period being measured in terms of said measured time information;

means responsive to said initiation/termination instructing means for coupling said chronometrical information signal generating means to said time reference signal generating means;

sequential response means operatively coupled to said chronometrical information signal generating means and said displaying means for making said displaying means sequentially responsive to one and the other of said more and less significant digit portions of said measured time information means responsive to said time reference signal for generating a horological information signal representative of the current time information;

means for selecting an operation mode of said electronic watch, said operation mode comprising a horological information mode and a chronometrical information mode, said displaying means being responsive to said horological information signal generating means or said chronometrical information signal generating means for displaying said current time information or said measured time information:

means responsive to said mode selecting means for selectively coupling said displaying means to said horological information signal generating means in said horological information mode and selectively coupling said displaying means to said chronometrical information signal generating means in said chronometrical information mode, said initiation/termination instructing means defining a time period being measured in terms of said measured time information in said chronometrical information mode, said initiation/termination instructing means further comprising, manually operable input means;

means responsive to a first input of said manually operable input means for assuming a first store state and responsive to a second input of said manually operable input means for assuming a second store state;

means operatively coupled to said state storing means for making said state storing means irresponsive to a third or further input of said manually operable input means; said sequential response means further comprising, means for commanding sequential response of said displaying means to said more significant or the less significant digit portion of said measured time information in said chronometrical information signal generating means; and means responsive to said sequential response commanding means for selectively and sequentially coupling said displaying means to said more significant or the less significant digit portion of said measured time information in said chronometrical information signal generating means, said sequential response commanding means further comprising, means responsive to said sequential response commanding means for making a timing operation for providing a timing signal for a predetermined time period, said sequential coupling means being adapted to be responsive to said timing signal of said timing means, whereby said display is switched from one to the other of said more and less significant digit portions of said measured time information in said chronometrical information signal generating means only during said predetermined time period of said timing means.

13. A digital display type electronic watch having a stopwatch function in accordance with claim 12, which further comprises means for clearing said chronometrical information signal generating means.

14. A digital display type electronic watch having a stopwatch function in accordance with claim 12, which further comprises means responsive to said timing means and said further input of said manually operable input means for clearing said chronmetrical information signal generating means.

15. A digital display type electronic watch having a stopwatch function in accordance with claim 12, wherein said sequential response means comprises means for commanding sequential response of said displaying means to said more significant or the less significant digit portion of said measured time information in said chronometrical information signal generating means, and means responsive to said sequential response commanding means for selectively and sequentially coupling said displaying means to said more significant or the less significant digit portion of said measured time information in said chronometrical information signal generating means.

16. A digital display type electronic watch having a stopwatch function in accordance with claim 13, said clearing means comprising:

manually operable means for commanding a clearing operation of said chronometrical information signal generating means; and means responsive to said manually operable clearing commanding means and said timing means for clearing said chronometrical information signal generating means.

17. A digital display type electronic watch having a stopwatch function in accordance with claim 12, wherein said sequential response commanding means comprises means responsive to said third or further input of said manually operable input means for providing a sequential response commanding signal, and said sequential coupling means is adapted to be responsive to said sequential commanding signal.

* * * * *